United States Patent [19]

Kohl et al.

[11] Patent Number: 4,761,204

[45] Date of Patent: Aug. 2, 1988

[54] CHEMICAL RECOVERY PROCESS USING BREAK UP STEAM CONTROL TO PREVENT SMELT EXPLOSIONS

[75] Inventors: Arthur L. Kohl, Woodland Hills; Albert E. Stewart, Eagle Rock, both of Calif.

[73] Assignee: Rockwell International Corporation, El Segundo, Calif.

[21] Appl. No.: 8,989

[22] Filed: Jan. 30, 1987

[51] Int. Cl.[4] ..... D21C 11/12

[52] U.S. Cl. ..... 162/30.1; 162/30.11; 110/189; 422/185; 423/DIG. 3; 432/4

[58] Field of Search ..... 162/30.1, 31, 30.11, 162/240; 422/185; 423/DIG. 3; 110/189; 432/4; 122/504

[56] References Cited

U.S. PATENT DOCUMENTS 2,967,758 1/1961 Thorson ..... 423/DIG. 3
3,122,421 2/1964 Gettle ..... 423/DIG. 3
4,017,254 4/1977 Jones ..... 110/189
4,312,702 1/1982 Tomlinson, II ..... 162/30.11

FOREIGN PATENT DOCUMENTS 1150283 4/1985 U.S.S.R. ..... 162/240

*Primary Examiner*—Steve Alvo
*Attorney, Agent, or Firm*—H. Fredrick Hamann; Harry B. Field; Clark E. DeLarvin

[57] ABSTRACT

An improvement in a chemical recovery process in which a hot liquid smelt is introduced into a dissolving tank containing a pool of green liquor. The improvement comprises preventing smelt explosions in the dissolving tank by maintaining a first selected superatmospheric pressure in the tank during normal operation of the furnace; sensing the pressure in the tank; and further impinging a high velocity stream of steam upon the stream of smelt whenever the pressure in the tank decreases below a second selected superatmospheric pressure which is lower than said first pressure.

12 Claims, 2 Drawing Sheets

CHEMICAL RECOVERY PROCESS USING BREAK UP STEAM CONTROL TO PREVENT SMELT EXPLOSIONS

STATEMENT OF GOVERNMENT INTEREST

The Government has rights in this invention pursuant to Prime Contract No. DE-AC05-80SC40341 awarded by the U.S. Department of Energy to Champion International (Rocketdyne Subcontract No. STR/DOE-12).

BACKGROUND OF THE INVENTION

1. Field of the Invention

The invention relates to a process for discharging a molten fluid from a furnace smelter into a dissolving tank. It is particularly applicable to chemical recovery furnaces such as those in which chemicals are recovered from the black liquor of wood pulp manufacture.

2. Description of the Prior Art

In the production of wood pulp, a chemical solution produced during one stage of the process is called black liquor and is obtained from wood being digested by the action of a chemical such as a mixture of sodium hydroxide and sodium sulfide. After the action of the chemical on the wood has been completed in a digester the residual liquor, usually called black liquor, contains salts which should be recovered from the standpoint of economical operation. The black liquor is evaporated to concentrate it and the concentrated black liquor is sprayed into a chemical recovery furnace which typically will comprise an oxidizing zone in an upper portion and a reducing zone in a lower portion. Most of the water remaining in the black liquor is driven off by the heat and drying is completed in the upper oxidation zone of the furnace. Dry solid particles are formed substantially free of moisture which collect on the bottom or hearth of the furnace. The combustible constituents of the dry particles are burned out and the heat that is generated is used for maintaining the chemical reactions taking place and also for producing steam in an associated boiler.

The inorganic ash remaining after the burning of the combustibles is fused by the heat of combustion. As this ash is melted, the oxidized forms of sulfur such as sodium sulfate, in the presence of carbon and a reducing atmosphere, are reduced to sodium sulfide. This sulfide together with other molten inorganic salts such as sodium carbonate is then removed from the furnace by discharge through a spout into a dissolving tank to form a solution known as green liquor. Discharge of the molten smelt into the liquid within a dissolving tank is generally accompanied by noise in the nature of a continuous roar at a high sound level and occasionally by violent and destructive explosions. Various systems have been proposed to eliminate or reduce this problem but none have been altogether successful and cost effective.

It has been found that the violence of the explosive reactions in the tank can be controlled by breaking up the stream of smelt issuing from the spout before the smelt comes into contact with the pool of green liquor in the tank. Typically, the shattering is accomplished by directing a jet of a gaseous medium such as steam against the stream of smelt which is leaving the spout. Since the quantity of smelt flow at any given time is highly variable, it is customary to direct an excessive amount of steam continuously against the smelt discharge at a pressure and velocity which would be adequate for breaking up even the heaviest smelt flow that would reasonably be expected. This technique obviously results in a considerable waste of steam and substantially reduces the economy of the chemical recovery process.

It has been proposed in Canadian Pat. No. 567,081 to direct a stream of steam vertically downward upon the flowing smelt and concurrently at a lower elevation within the tank to use a recirculated liquor stream to further shatter and disperse the smelt stream. The disadvantage of this process is that it relies upon continuous streams of both steam and green liquor.

U.S. Pat. No. 3,122,421 also describes an apparatus and method for dispersing or shattering a stream of smelt using steam. The novel aspect of this invention appears to reside in using the spout cooling water temperature as an indication of the amount of smelt flowing and therefore of the amount of steam required to shatter the smelt. Thus this patent also requires a continuous flow of steam although it may not be quite as wasteful as some of the other approaches. It also requires a water-cooled spout.

U.S. Pat. No. 4,011,047 describes a smelt spout for a recovery boiler which does not require water cooling. The spout is constructed from insulating and refractory material contained in a metal trough and is provided with a steam jet immediately adjacent the bottom free end of the spout. The jet impairs the formation of slag on the bottom of the trough and disintegrates the smelt stream issuing from the spout. Thus, this approach also requires a continuous flow of steam with its attendant economic penalty.

OBJECTS OF THE INVENTION

It is the primary object of the invention to increase the operating efficiency and operating safety of a chemical recovery furnace and its associated apparatus.

A more specific object of the invention is to eliminate the need for a continuous flow of steam to shatter a flowing stream of smelt.

Another object of the invention is to eliminate the need for using steam to shatter the smelt during normal operation of a chemical recovery furnace.

It also is an object of the invention to provide a process as described above which is uniquely suited for use with a furnace which is operated at an elevated pressure and in which the black liquor is only partially oxidized such that there is produced a combustible product gas which after cleaning may be used as a fuel gas for a gas turbine.

SUMMARY OF THE INVENTION

The foregoing and other objects and advantages are obtained in accordance with the present invention which comprises an improvement in a chemical recovery process. The chemical recovery process employs a furnace having a lower portion from which there is discharged a hot liquid smelt via a smelt spout into a quenching and dissolving tank containing a pool of green liquor. During operation of the process the smelt is discharged in a continuous yet variable quantity. The present invention provides a process of preventing smelt explosions when such a stream is introduced into the dissolving tank.

In the process a first selected superatmospheric pressure is maintained in the dissolving tank during normal operation of the furnace, which pressure is typically in excess of about 7 atmospheres such that the probability of a smelt explosion is substantially eliminated. The pressure in the tank is sensed and a stream of high velocity steam is impinged on the stream of smelt only when the pressure in the tank is below a second selected superatmospheric pressure; the second selected pressure being less than the first selected pressure. By so doing, smelt explosions within the tank due to contact of the hot smelt with the pool of green liquor are effectively eliminated during all phases of operation of the furnace, including startup and shutdown of the furnace operations, without the requirement for a continuous flow of steam.

In accordance with a preferred embodiment of the invention, the process includes impinging a stream of said green liquor upon the stream of smelt leaving the spout to shatter the stream of smelt before it arrives at the surface of the pool of green liquor in the tank.

In accordance with another preferred aspect of the invention, the smelt is produced by the partial combustion of concentrated black liquor in a furnace maintained at a superatmospheric pressure and there also is produced a combustible product gas in the furnace. In accordance with a particularly preferred embodiment of the invention, the first selected superatmospheric pressure is in excess of about 7 atmospheres, typically 10 to 20 atmospheres and the second selected superatmospheric pressure is in the range of from about 5 to 10 atmospheres. In accordance with certain other preferred aspects of the invention, the stream of steam is impinged in a substantially vertically downward direction upon the smelt and the stream of green liquor is impinged in a substantially horizontal direction upon the stream of smelt. In accordance with yet another preferred aspect of the invention, the green liquor in the pool is maintained at a temperature within about 44° C. (80° F.) of its boiling point at the pressure existing in the dissolving tank.

Further features, aspects, objects and advantages of the invention will be evident from the following detailed description of the preferred embodiment of the present invention taken in conjunction with the accompanying drawings.

DETAILED DESCRIPTION OF THE PREFERRED EMBODIMENT

Figure 1:
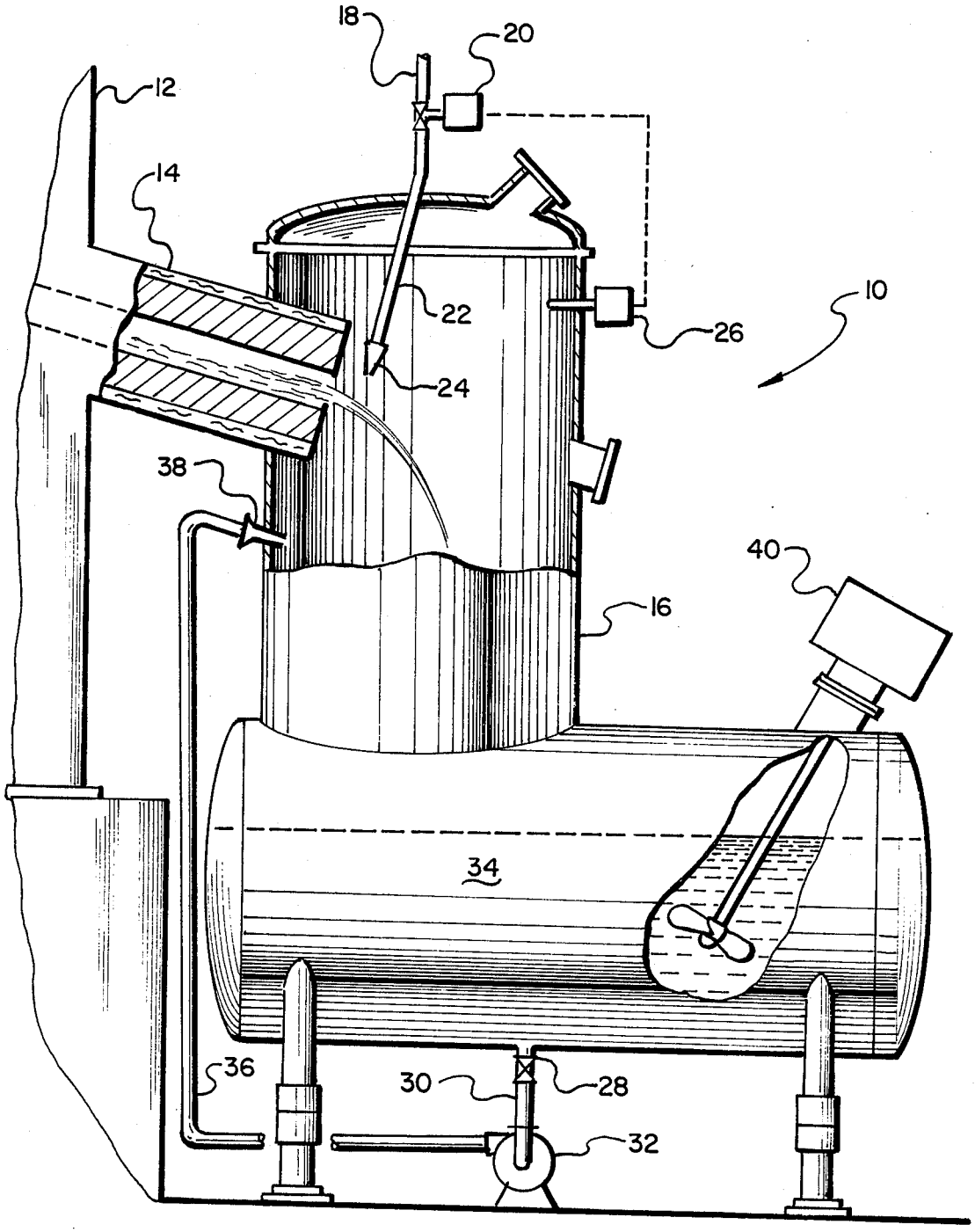
FIG. 1 is an elevation view partially in cross-section of an apparatus for use with the process of the present invention.

Referring to FIG. 1 therein is depicted an apparatus 10 incorporating the present invention. The apparatus includes a recovery furnace 12, a smelt discharge spout 14 and a dissolving tank 16. Dissolving tank 16 is provided with a means for introducing steam from a source (not shown) through a conduit 18, control valve 20, conduit 22 and nozzle 24. Control valve 20 is regulated or controlled by a pressure sensor 26. Located adjacent a lower portion of dissolving tank 16 there is provided a valve 28, conduit 30 and pump 32 for withdrawing green liquor from a pool 34 contained within quench vessel 16. The green liquor is discharged from pump 32 via a conduit 36 and reintroduced into vessel 16 through a nozzle 38. Typically, dissolving tank 16 also is provided with a motor-driven mixer 40 to aid in dispersing and dissolving particles of solidified smelt.

To demonstrate the effect of pressure and green liquor temperature on both the probability and severity of explosions during a quenching operation, a series of tests were conducted. The tests utilized a smelt which would simulate the materials produced during the operation of a recovery furnace for processing a Kraft black liquor. The simulated materials contained higher ash and carbon concentrations since they were actually obtained from the gasification of coal in a molten salt. The green liquor was made up from the smelt samples. Typical compositions of the smelt and green liquor are given in Tables 1 and 2 below. The tests were conducted by quickly pouring a predetermined amount of high temperature molten salt into a pool of green liquor within a closed vessel and noting whether or not an explosion took place and measuring the force of the explosion when one occurred.

TABLE 1

| TYPICAL SMELT COMPOSITION | |
|---|---|
| Compound | Concentration (wt. %) |
| $Na_2CO_3$ | 57.6 |
| $Na_2S$ | 13.0 |
| $Na_2SO_3$ | 0.5 |
| $Na_2SO_4$ | 1.4 |
| NaCl | 0.3 |
| Carbon | 1.2 |
| Ash | 15.2 |
| Other* | 10.9 |

*By difference, includes all water-soluble compounds not listed.

TABLE 2

| TYPICAL GREEN LIQUOR CHARACTERISTICS | |
|---|---|
| Composition | |
| Water | 69.8 wt. % |
| Smelt | 21.6 wt. % |
| $NaHCO_3$ | 8.6 wt. % |
| Properties | |
| Viscosity | 175 cP at 21° C. (70° F.) |
| Specific gravity | 1.28 at 21° C. (70° F.) |
| Boiling point | 105° C. (221° F.) at 1 atm |
| pH | 11.5 |

In addition, a number of tests were performed using smelt that had been sensitized to increase the probability of an explosion. The smelt was sensitized by the addition thereto of either 5 wt. % NaOH or 5 wt. % NaCl to the reference smelt. Both of these materials proved to be effective sensitizers and no clear cut difference between the two was observed. In addition, in some of the tests water was used as a quenching medium instead of green liquor. The use of water, however, appeared to have little effect on the probability of explosions.

The quantity of smelt quenched was typically 65 grams. This quantity was selected on the basis of preliminary screening tests in which the amount of smelt was varied from about 35 to 150 grams. Smaller quantities appeared to give inconsistent results. The tests with quantities greater than 65 grams did not show an effect on the probability of explosions but did indicate that the magnitude or intensity of the explosion was roughly proportional to the amount of smelt quenched.

Figure 2:
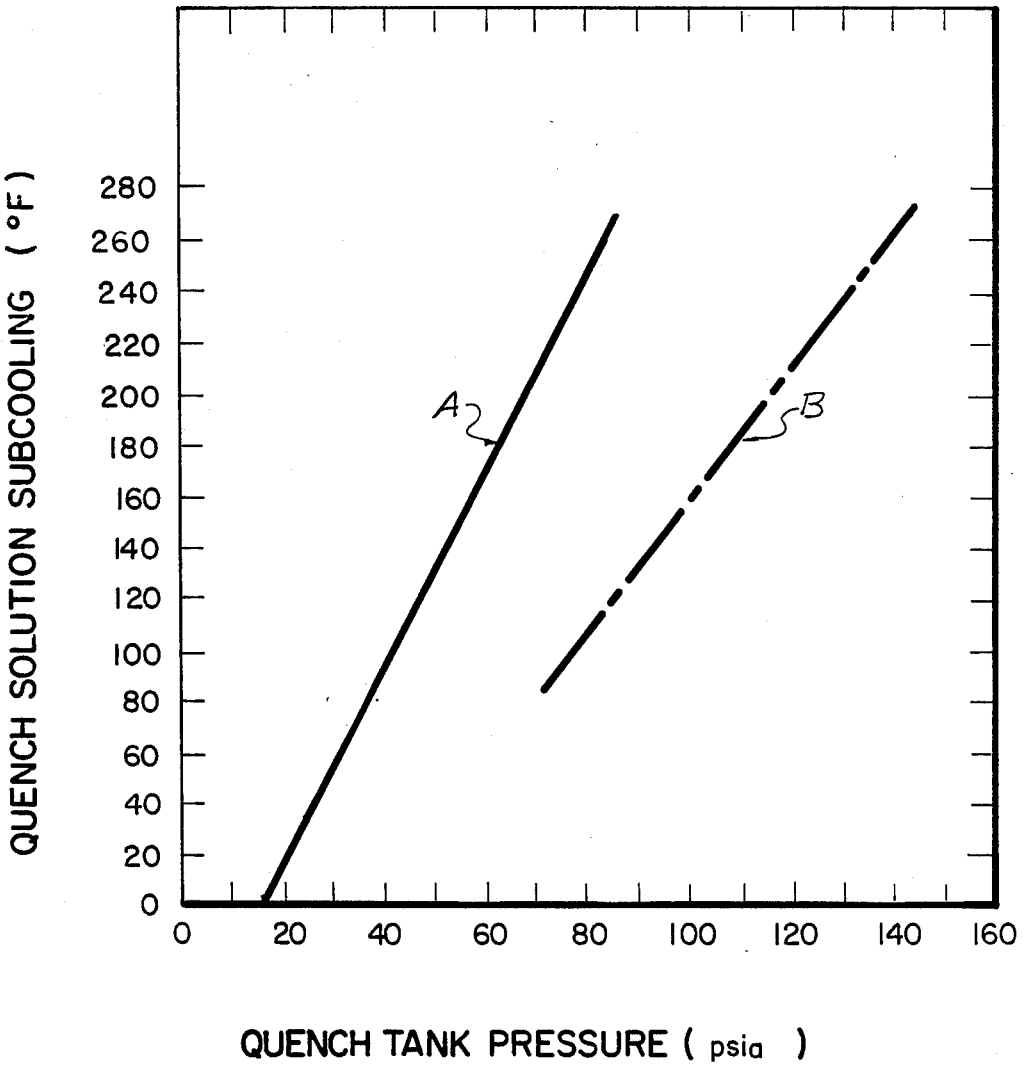
FIG. 2 is a graph showing the effect of quench tank pressure and quench solution temperature on the probability of explosions during a smelt quenching process.

The results of all of the smelt quench tests are summarized in FIG. 2. Lines A and B define the approximate regions of low explosion probability for nonsensitized and sensitized smelts respectively under the conditions of the test, where low explosion probability represents conditions under which no explosions were observed during the tests. Areas to the right of the lines represent the regions of low explosion probability. The results showed that at any temperature (or degree of subcooling) increasing the pressure eventually leads to a condition of low explosion probability with either sensitized ot nonsensitized smelts. As indicated by the lines, decreasing the quench solution subcooling decreases the pressure required to assure a low probability of explosions for both sensitized and nonsensitized smelts. Subcooling is defined as the difference between the boiling point of the quench solution at the pressure existing in the dissolving tank and its actual temperature in the dissolving tank. The region to the left of line A represents conditions under which there is a high probability of explosions for both sensitized and nonsensitized smelts. The area between lines A and B is the region of low explosion probability for nonsensitized smelts. The region to the right of line B is the region of low explosion probability for both sensitized and nonsensitized smelts. From FIG. 2 it is seen that at pressures above about 10 atmospheres (150 psi) the probability of explosions with either a sensitized or nonsensitized smelt is substantially negligible. Further, maintaining the solution at a temperature within about 80° F. (44° C.) of its boiling point results in a low probability of an explosion at pressures down to about 5 atmospheres (75 psia).

Referring back to FIG. 1, the preferred mode of operation would be substantially as follows:

Concentrated black liquor is introduced into an upper portion of furnace 12 where it is concentrated and converted into a low BTU gas and a reduced smelt by partial oxidation with air. Typically, furnace 12 is operated at an elevated pressure since this reduces the size of the equipment, improves operation of the gas cleanup and provides a gaseous product at a suitable pressure for use as fuel to, for example, a gas turbine. Typically, furnace 12 is maintained at a pressure in excess of about 7 atmospheres. Preferably in the range of from about 10 to 20 atmospheres.

During the gasification process inorganic components of the black liquor are melted. The sulfur compounds are reduced to the sulfide form and the product smelt is continuously discharged from the bottom of furnace 12 through spout 14 and into dissolving tank 16 which is maintained at substantially the same pressure as furnace 12. The stream of smelt entering tank 16 is shattered by a substantially horizontal spray of green liquor before it enters pool 34. The spray of green liquor is produced by withdrawing green liquor from pool 34 through conduit 30 and pump 32 which circulates it through conduit 36 and nozzle 38, the latter of which directs the green liquor such that it impinges upon the smelt entering tank 16. During normal operation this continuous circulation of green liquor through nozzle 38 or even the agitation produced by mixer 40 is sufficient to shatter the smelt and provide a substantially uniform dispersion of dissolving smelt particles in green liquor. Dissolving tank 16 also will be provided with means for introducing makeup water, withdrawal of green liquor for recycle to the pulping process and venting gases. However, since these aspects are well known to those skilled in the art and form no part of the present invention, they are not shown.

Whenever the pressure in dissolving tank 16 drops below a preset superatmospheric pressure which is below the normal operating pressure, and still above that at which the probability of an explosion is higher than acceptable for safe operation, pressure sensor 26 opens control valve 20 and permits high pressure steam from a source not shown to flow through conduit 22 and nozzle 24 to thoroughly shatter and disperse the flowing stream of smelt thereby reducing the probability of an intense explosion if the pressure should continue to decline. In accordance with a preferred embodiment of the present invention, valve 20 is opened whenever the pressure drops below 5 atmospheres and preferably whenever it drops significantly below the normal operating pressure.

The temperature of the green liquor preferably is maintained within about 44° C. (80° F.) of its boiling temperature at the dissolving tank pressure to further reduce the probability of an intense explosion. It will be appreciated that if desired, the temperature of the green liquor in pool 34 could be monitored and that temperature additionally used as a means for actuating control valve 20.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. In a chemical recovery process employing a furnace having a lower portion from which is discharged in a continuous yet variable quantity a stream of hot liquid smelt via a smelt spout into a dissolving tank partially filled with a pool of green liquor, the method of preventing smelt explosions in said tank comprising: maintaining a first selected superatmospheric pressure in excess of about 7 atmospheres in said tank during normal operation of the furnace, providing a steam source, a steam control valve, and a steam outlet nozzle for directing steam from said source at said stream of liquid smelt flowing from said spout, sensing the pressure in said tank with a pressure sensor which acts to maintain said control valve in the closed position during normal operation at said first superatmospheric pressure, and acts to maintain said control valve in an open position below a second selected superatmospheric pressure in said tank to discharge a high-velocity stream of steam through said nozzle in an amount sufficient to break up said stream of smelt whenever the pressure in said tank is below said second selected superatmospheric pressure, said second selected superatmospheric pressure being significantly below said first selected superatmospheric pressure, to that smelt explosions within said tank from contact of said hot smelt with the pool of green liquor are effectively eliminated during all phases of operation of the furnace.

2. The process of claim 1 wherein said smelt is produced by the partial combustion of concentrated black liquor in said furnace such that there also is produced a combustible product gas.

3. The process of claim 1 wherein said first selected superatmospheric pressure is in the range of 7 to 20 atmospheres and said second selected superatmospheric pressure is about 5 atmospheres.

4. The process of claim 1 wherein said stream of steam is impinged in an approximately vertical downward direction upon said smelt.

5. The process of claim 1 further including impinging a stream of said green liquor upon said stream of smelt leaving the spout to shatter said smelt before it arrives at the surface of the pool of green liquor in the tank.

6. The process of claim 5 wherein said stream of green liquor is impinged in a substantially horizontal direction upon said stream of smelt.

7. The process of claim 1 further including maintaining said pool of green liquor at a temperature within about 44° C. of its boiling point at the pressure existing in the dissolving tank.

8. The process of claim 1 wherein said pool of green liquor is continuously agitated to aid in dispersing and dissolving smelt particles.

9. The process of claim 7 including further impinging upon said stream of smelt said high velocity stream of steam whenever the pool of green liquor is at a temperature which is lower than a selected value within about 44° C. of its boiling point at the pressure existing in said dissolving tank.

10. The process of claim 7 wherein said stream of steam is impinged in a vertically downward direction upon said smelt.

11. The process of claim 10 wherein a stream of green liquor is impinged in a substantially horizontal direction upon said stream of smelt.

12. The process of claim 11 wherein said pool of green liquor is continuously agitated to aid in dispersing and dissolving smelt particles.

* * * * *